US007443294B2

(12) United States Patent
Loudon

(10) Patent No.: US 7,443,294 B2
(45) Date of Patent: Oct. 28, 2008

(54) ELECTRONIC LOCK-OUT TAG-OUT SAFETY DEVICE

(76) Inventor: Gary J. Loudon, 16 Andrewsville St., Lansford, PA (US) 18232

( * ) Notice: Subject to any disclaimer, the term of this patent is extended or adjusted under 35 U.S.C. 154(b) by 172 days.

(21) Appl. No.: 11/401,545

(22) Filed: Apr. 11, 2006

(65) Prior Publication Data

US 2006/0232404 A1 Oct. 19, 2006

Related U.S. Application Data

(63) Continuation-in-part of application No. 10/435,997, filed on May 12, 2003, now Pat. No. 7,026,932.

(51) Int. Cl.
*G08B 13/14* (2006.01)

(52) U.S. Cl. ..... 340/568.1; 340/539.1; 340/545.2

(58) Field of Classification Search ..... 340/568.1, 340/541, 539.1, 652, 571, 540, 547, 566, 340/686.1, 545.2, 521, 546, 554
See application file for complete search history.

(56) References Cited

U.S. PATENT DOCUMENTS

| | | | | |
|---|---|---|---|---|
| 4,319,228 | A * | 3/1982 | Daniels | 340/521 |
| 5,311,168 | A * | 5/1994 | Pease et al. | 340/542 |
| 5,656,996 | A * | 8/1997 | Houser | 340/541 |
| 6,060,982 | A * | 5/2000 | Holtrop | 340/432 |
| 6,720,874 | B2 * | 4/2004 | Fufido et al. | 340/541 |
| 6,778,083 | B2 * | 8/2004 | Auerbach et al. | 340/539.1 |
| 7,026,932 | B2 * | 4/2006 | Loudon | 340/568.1 |

* cited by examiner

*Primary Examiner*—Anh V La
(74) *Attorney, Agent, or Firm*—Dariel P. Burke & Associates, PLLC

(57) ABSTRACT

An electronic lock-out tag-out system comprising a transmitter lock and a portable receiver. One or more switches of the transmitter lock is connected to a utility box or the like and are actuated when the transmitter lock is moved or removed. When the switch is activated, an alarm is sounded in the transmitter lock and a signal is transmitted to the receiver to sound an alarm in the receiver.

20 Claims, 7 Drawing Sheets

ELECTRONIC LOCK-OUT TAG-OUT SAFETY DEVICE

RELATED APPLICATION DATA

This application is a continuation-in-part of U.S. Pat. No. 7,026,932, issued Apr. 11, 2006, Ser. No. 10/435,997, filed on May 12, 2003.

The invention relates to safety devices. More particularly, the invention relates to an electronic apparatus for isolating equipment during maintenance or service work to ensure that personnel are not injured from accidental machine start-ups or electrical shock.

BACKGROUND

During installation, service and maintenance of powered equipment, service personnel such as electricians must assure that the equipment is isolated from its power source. Examples of such equipment include, but are not limited to, high voltage power supplies, milling machines, boilers, electron microscopes, elevators, fan systems, and lasers. Although the power source is usually electrical, other power sources such as mechanical, hydraulic, pneumatic, chemical, and thermal may be involved.

When the power source and the equipment are in the same room, isolation is not difficult. However, more often than not, the power source, e.g. breaker box, is located relatively far away from the equipment. Thus, it is possible that after the equipment is isolated at the power source it may be inadvertently powered on by other personnel who do not know that the equipment was intentionally powered off. Work situations where unexpected energizing or start-up can occur include new construction, installation or set-up of equipment, and the adjustment, inspection, maintenance, repair, and service of machines and equipment.

"Lock-out" and "Tag-out" refer to safe methods for the complete power isolation of equipment during maintenance or service work. OSHA regulations 29 CFR 1910.147 and 1926.416 require the use of locks or tags at control points such as breaker boxes as warning devices to ensure that personnel are not injured from accidental machine start-ups. While many lock-out and tag-out solutions perform well, none are fool proof. For example, tag-out solutions assume that all personnel can read the same language. Although lock-out solutions do not require literacy on the part of personnel, lock-outs are difficult to install and often require that the device to be locked is pre-equipped with a lock receiving apparatus. In addition, a lock-out may be bypassed intentionally or accidentally without the knowledge of the affected personnel.

SUMMARY OF THE INVENTION

One preferred embodiment of the present invention provides an electronic lock-out tag-out safety device which includes two parts: a transmitter lock and a portable receiver. The transmitter lock is designed to be attached to a utility box or power switch and to transmit a signal which is received by the portable receiver which is proximate the affected personnel. The presently preferred transmitter lock includes one or more electromagnets which are activated by a key switch on the transmitter lock. Turning this key switch also arms the transmitter. The transmitter lock also includes a spring biased switch on the same side of the transmitter lock as the magnets. The switch is coupled to an alarm. When the transmitter lock is positioned on a utility box or power switch, the spring biased switch is depressed. If the transmitter lock is removed, a spring biases the switch outwardly and signals an alarm to sound at both the transmitter lock and the receiver. The transmitter lock can also be provided with a vibration sensor which is activated and sounds an alarm whenever the transmitter/lock is moved. Preferably, the alarms will sound both at the transmitter lock and at the receiver until the affected personnel uses a key to turn off the alarm at the transmitter lock. The transmitter lock preferably also includes indicia indicating the name or some other identifying information of the affected personnel.

The various embodiments of the present invention advantageously provide a lock-out tag-out system which does not rely on the literacy of personnel, cannot be bypassed without the knowledge of the affected personnel, and is easy to attach to a variety of different power switches.

DETAILED DESCRIPTION

Figure 1:
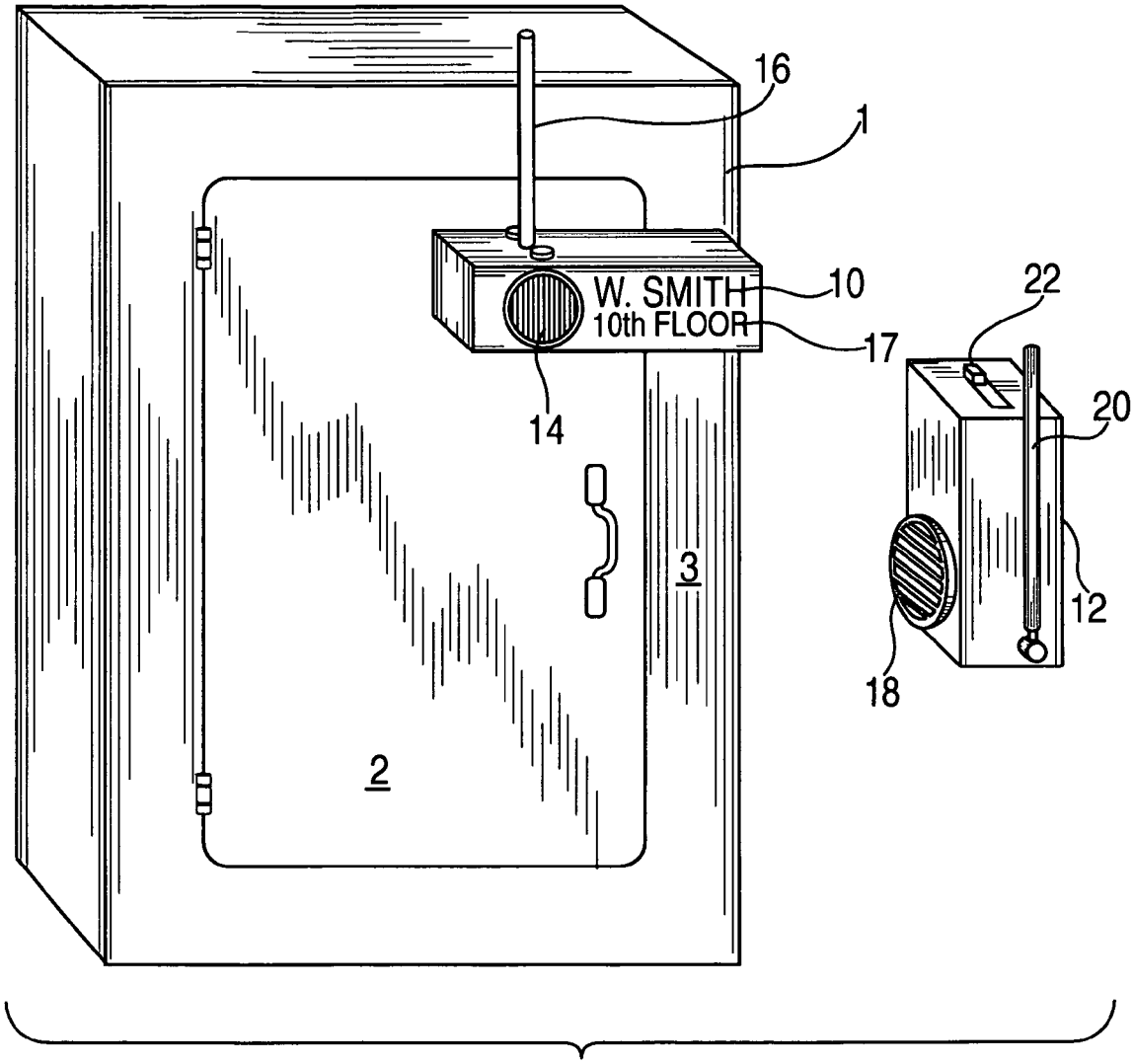
FIG. 1 is perspective view of a transmitter lock and a portable receiver according to one embodiment of the invention with the transmitter lock attached to an electrical cabinet.

FIG. 1 illustrates one electronic lock-out tag-out system according to one embodiment of the present invention which comprises a transmitter lock 10 and a portable receiver 12. The transmitter lock 10 includes a speaker 14, an antenna 16, editable indicia 17 and an outwardly attending spring biased switch 28 best shown in FIG. 5. The indicia 17 preferably indicates the name and location of the affected personnel. The portable receiver 12 includes a speaker 18, and antenna 20, and a power switch 22.

As illustrated in FIG. 1, the transmitter lock 10 is attached to a utility box 1 straddling the door 2 and the door frame 3. The attachment is made by one or more magnets (described in detail below) in the transmitter lock 10. It will be appreciated that when the transmitter lock 10 is mounted as shown in FIG. 1, the door 2 of the utility cabinet 1 cannot be opened without moving or removing the transmitter lock 10. Movement of the transmitter lock enables the spring biased switch to extend and a signal is sent to one, and preferably both, audible alarms. A visible signal can be provided in addition to or in place of the audible signal. Other types of motion switches, such as vibration sensors can also be used without departing from the scope of the present invention.

Figure 2:
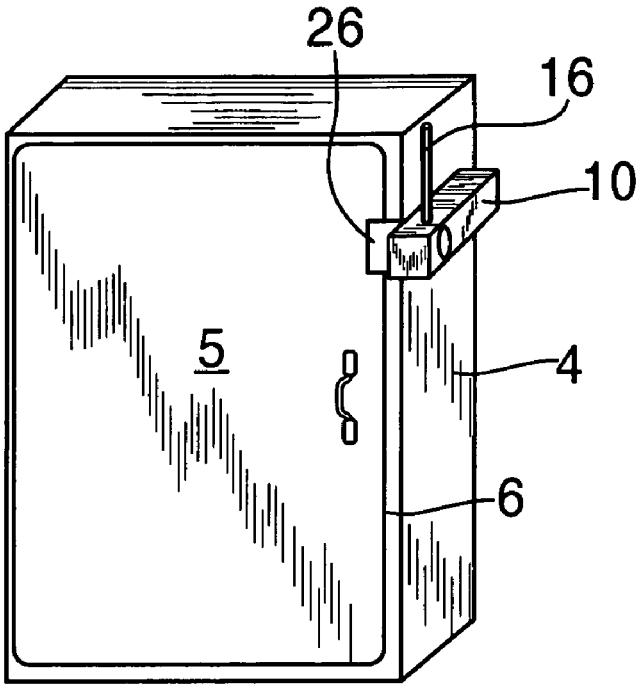
FIG. 2 is a perspective view of a transmitter lock attached to another type of cabinet.

FIG. 2 illustrates an alternative placement of the transmitter lock 10 which utilizes a folding flap 26 (described in detail below) to obstruct the door 5 of utility cabinet 4. The flap 26 is long enough to extend over the door frame 6 and cover a portion of the door 5.

Figure 3:
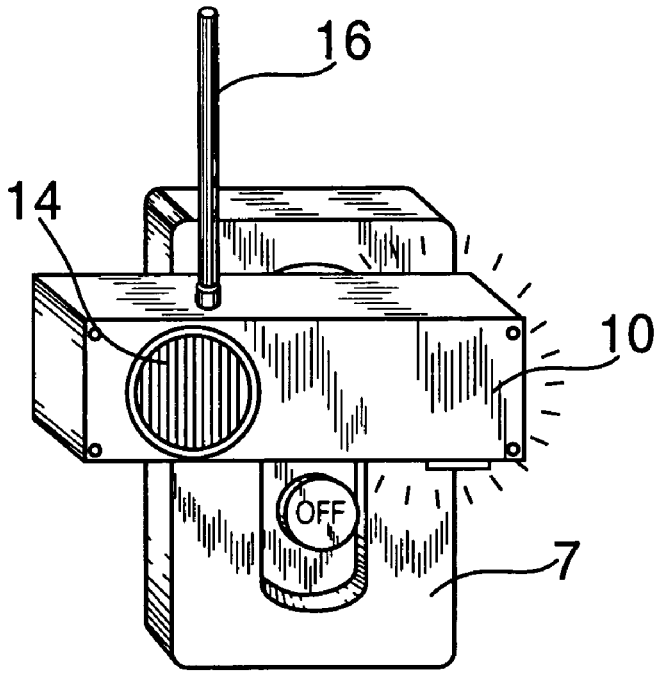
FIG. 3 is a perspective view of a transmitter lock attached to a power switch.

FIG. 3 illustrates yet another placement of the transmitter lock 10 to cover a power switch 7 thereby preventing the switch from being closed without removing the transmitter lock 10.

Figure 4:
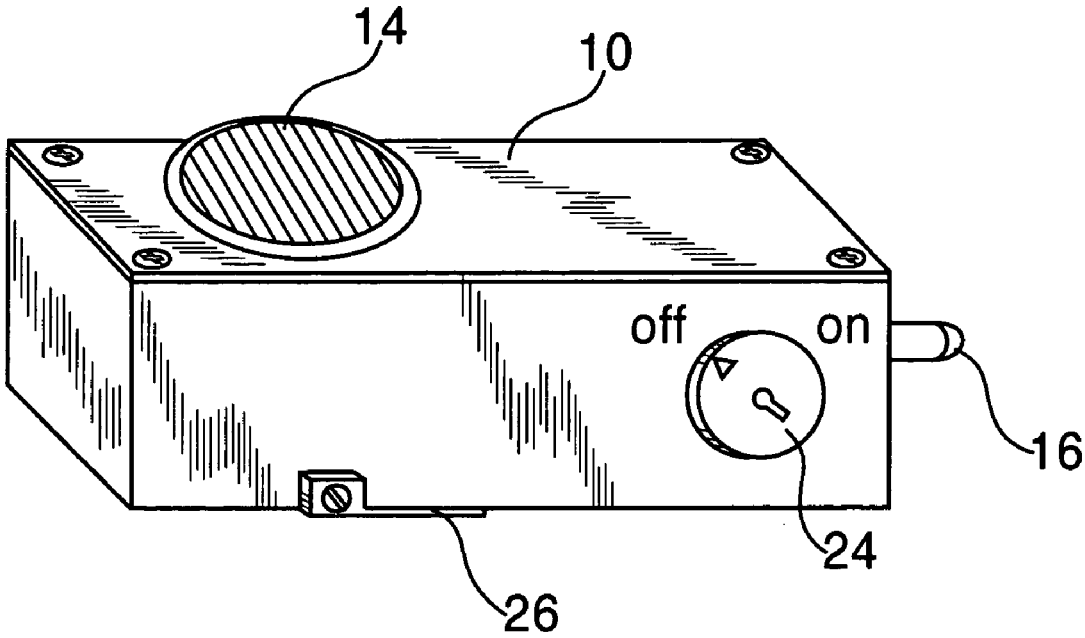
FIG. 4 is a perspective view of a transmitter lock of one embodiment of the present invention showing a key switch.
Figure 5:
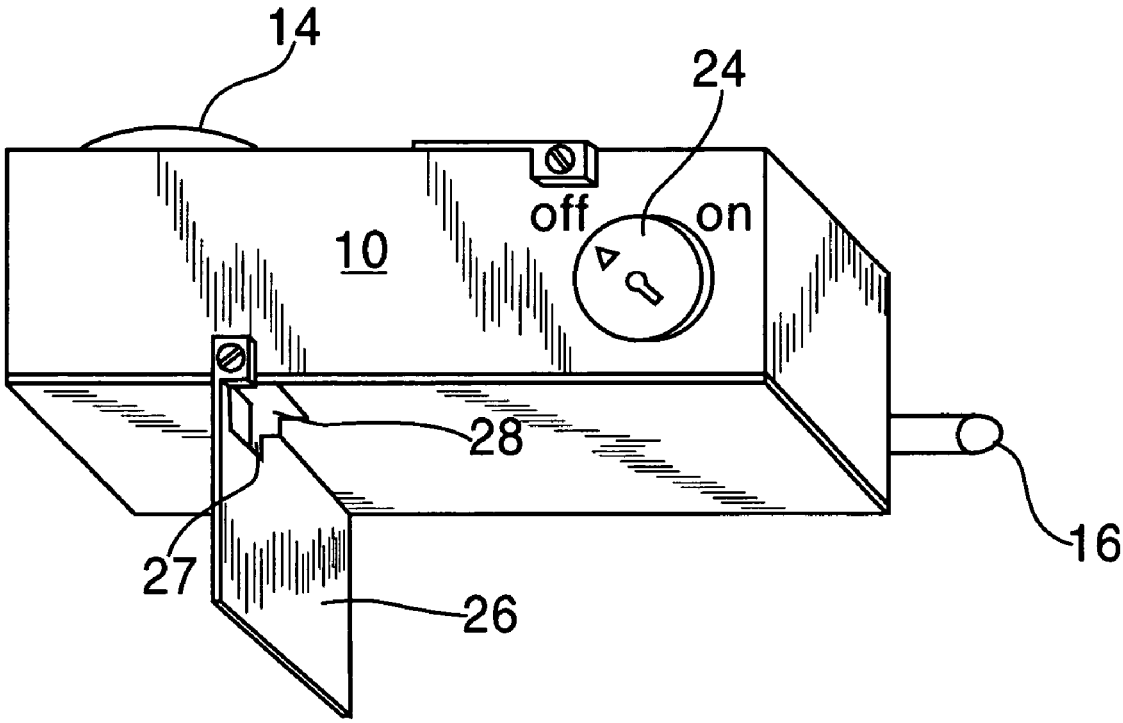
FIG. 5 is a perspective view of a transmitter lock of one embodiment the present invention with a spring biased switch and hinged door.
Figure 6:
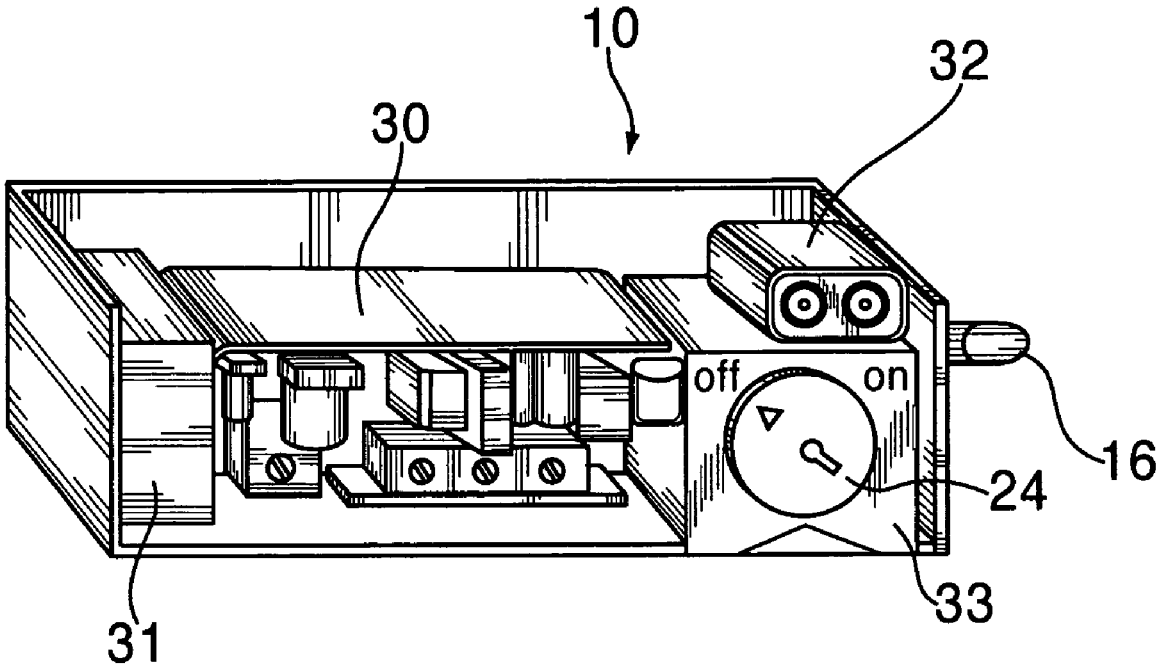
FIG. 6 is a partially cut away perspective view of a transmitter lock of one embodiment of the present invention.

FIGS. 4-6 illustrate additional details of the transmitter lock 10. As shown in FIGS. 4 and 5, the exterior of the illustrated transmitter lock 10 comprises a key switch 24 and folding flap 26 which is adjacent to the spring biased switch 28. As seen best in FIG. 5, the flap 26 includes an opening 27 through which the switch button 28 may pass when the flap 26 is folded shut as shown in FIG. 4.

FIG. 6 illustrates the interior of the transmitter lock 10 which includes a circuit board 30 and a battery 32. As shown in FIG. 6, a permanent magnet 31 is placed on one side of the circuit board 30 and another permanent magnet 33 surrounds the key switch 24 on the other side of the circuit board 30. The electrical components of the transmitter lock 10 are described in further detail below with reference to FIG. 8.

Figure 7:
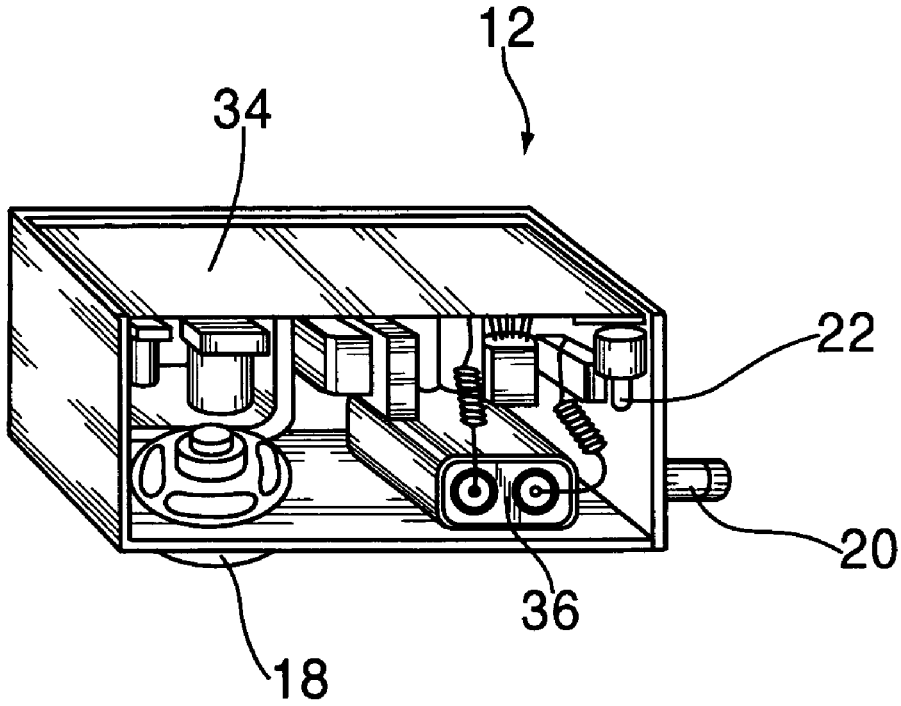
FIG. 7 is a partially cut away perspective view of a portable receiver of one embodiment of the present invention.

FIG. 7 illustrates the interior of the portable receiver 12 which includes a circuit board 34 and a battery 36. The electrical components of the portable receiver 12 are described in further detail below with reference to FIG. 9.

Figure 8:
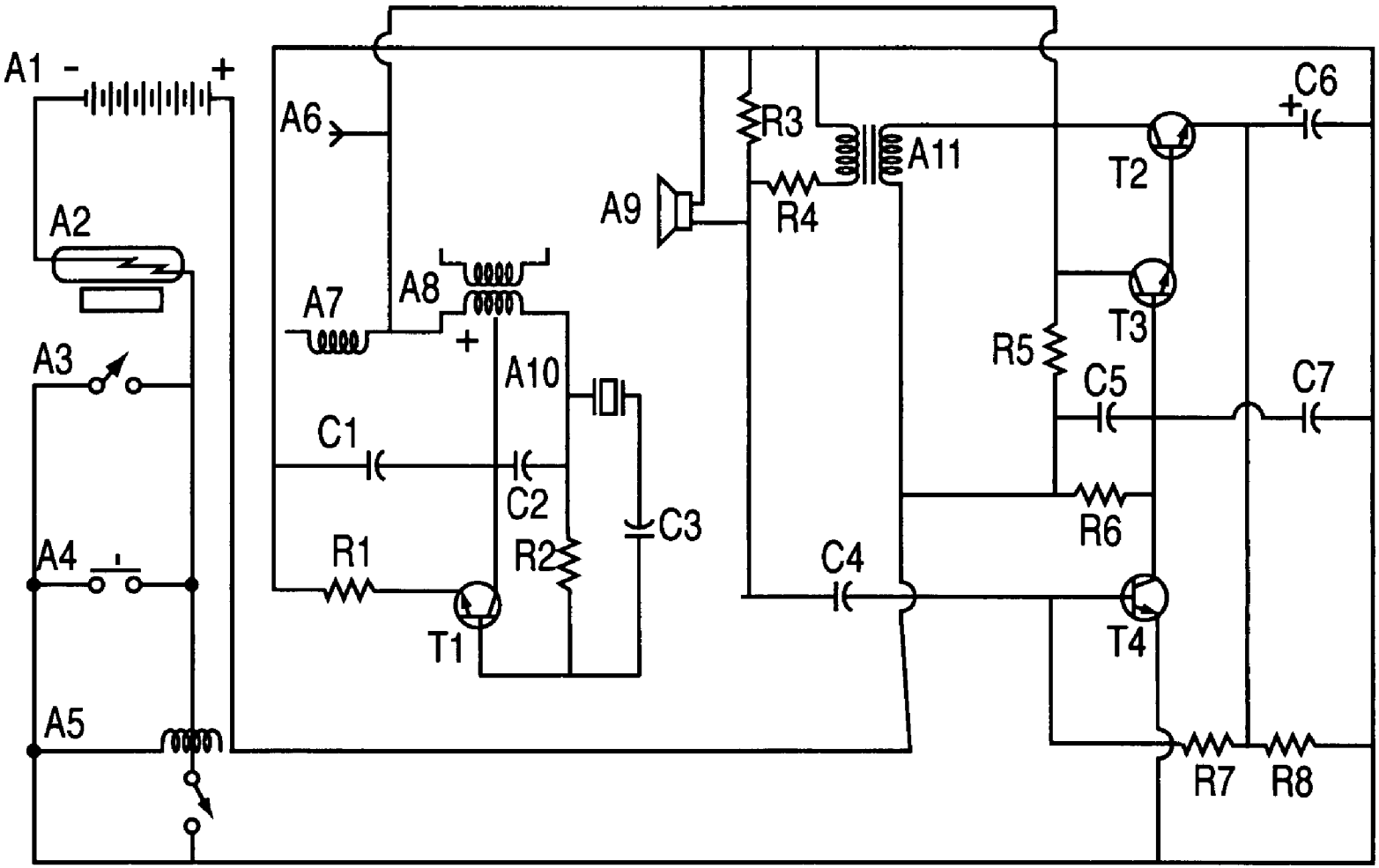
FIG. 8 is a schematic diagram of a transmitter lock of one embodiment of the present invention.

Turning now to FIG. 8, an exemplary transmitter circuit is illustrated in a schematic diagram. It will be noted that there are no electromagnets in this embodiment and that the key switch is not illustrated. The diagram does show a magnetic reed switch A2 which deactivates the transmitter when it is disassembled, a vibration contact switch A3 which activates the transmitter when it is moved, as well as the spring biased switch A4. A list of the electrical components is listed below in Table 1. It will be noted that the frequency of the transmitter is controlled by the crystal A10 which is preferably in the 49-50 MHz range, a band which is available for public use in the U.S. Other types of motion switches, such as vibration sensors can also be used without departing from the scope of the present invention.

TABLE 1

TRANSMITTER PARTS

| Part Number | Description |
|---|---|
| A1 | 9 volt battery |
| A2 | magnetic reed switch (normally open) |
| A3 | vibration contact switch (normally open) |
| A4 | spst momentary contact push button switch |
| A5 | spst relay |
| A6 | antenna |
| A7 | choke |
| A8 | choke |
| A9 | 8-ohm 0.5 watt speaker |
| A10 | 49.860 MHz crystal |
| A11 | output transformer |
| T1 | NPN K.8E C3192 |
| T2 | NPN F22L2 9843 |
| T3 | NPN W81 F824 |
| T4 | NPN C9014 C-7L |
| R1 | 47 ohms |
| R2 | 12K ohms |
| R3 | 10 ohms |
| R4 | 320 ohms |
| R5 | 100K ohms |

TABLE 1-continued

TRANSMITTER PARTS

| Part Number | Description |
|---|---|
| R6 | 2.7K ohms |
| R7 | 150K ohms |
| R8 | 27 ohms |
| C1 | 33 pF |
| C2 | 22 pF |
| C3 | 15 pF |
| C4 | 403 pF |
| C5 | 403 pF |
| C6 | 47 uF |
| C7 | 203 pF |

Figure 9:
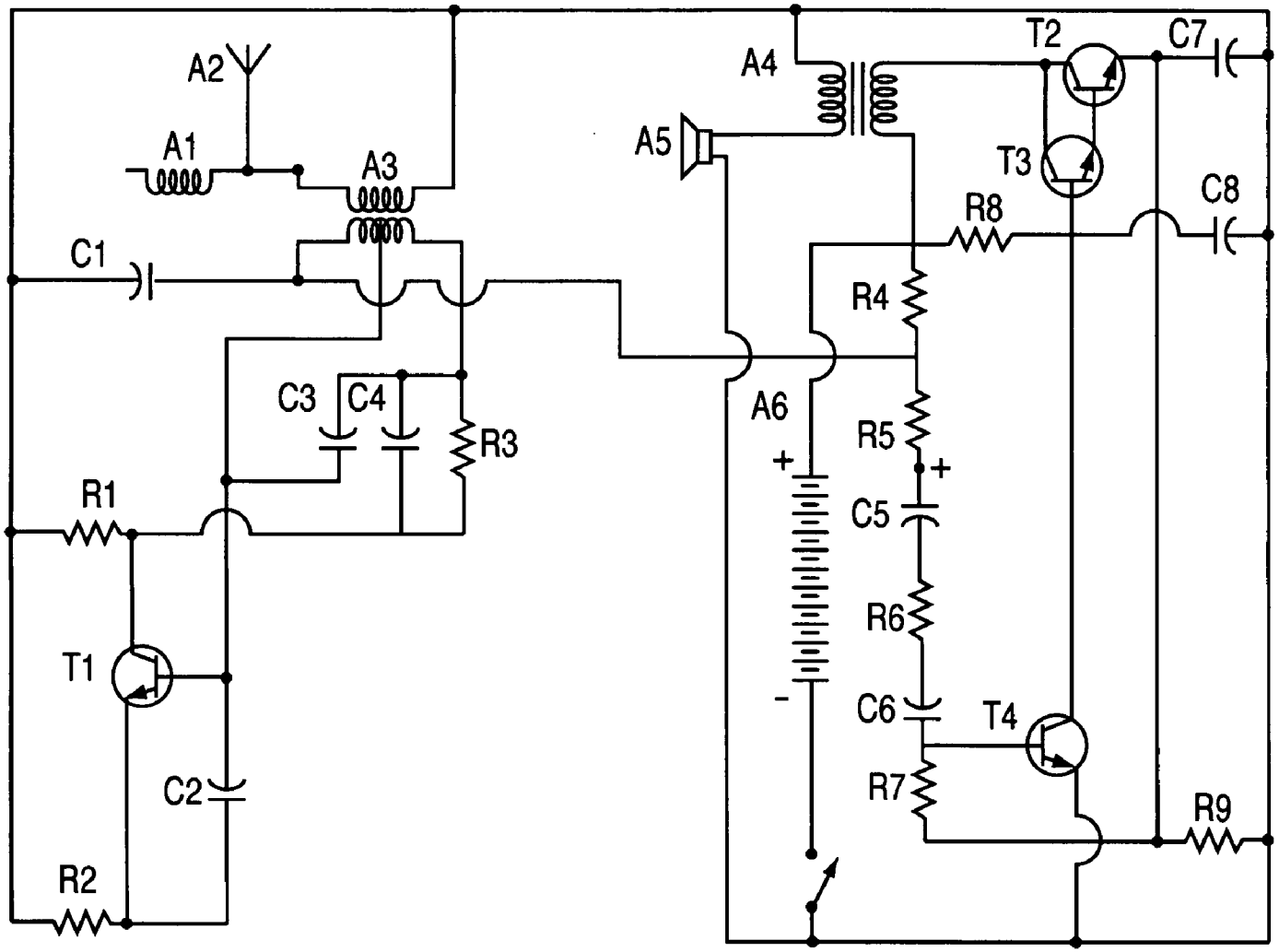
FIG. 9 is a schematic diagram of a portable receiver of one embodiment of the present invention.

Turning now to FIG. 9, an exemplary receiver circuit is illustrated in a schematic diagram. It will be noted that the receiver is not crystal controlled but is tunable via the choke A3. A list of the electrical components of the receiver is listed below in Table 2.

TABLE 2

RECEIVER PARTS

| Part Number | Description |
|---|---|
| A1 | choke |
| A2 | antenna |
| A3 | choke |
| A4 | output transformer |
| A5 | 8-ohm 0.5 watt speaker |
| A6 | 9 volt battery |
| A7 | spst switch |
| T1 | NPN K.8E C3192 |
| T2 | NPN F22L2 9843 |
| T3 | NPN W81 F824 |
| T4 | NPN C9014 C-7L |
| R1 | 4.7K ohms |
| R2 | 47 ohms |
| R3 | 15K ohms |
| R4 | 8.2K ohms |
| R5 | 330 ohms |
| R6 | 1K ohms |
| R7 | 150K ohms |
| R8 | 4.7K ohms |
| R9 | 47 ohms |
| C1 | 332 pF |
| C2 | 33 pF |
| C3 | 22 pF |
| C4 | 502 pF |
| C5 | 50 vlu |
| C6 | 403 pF |
| C7 | 16 v47 |
| C8 | 203 pF |

Figure 10:
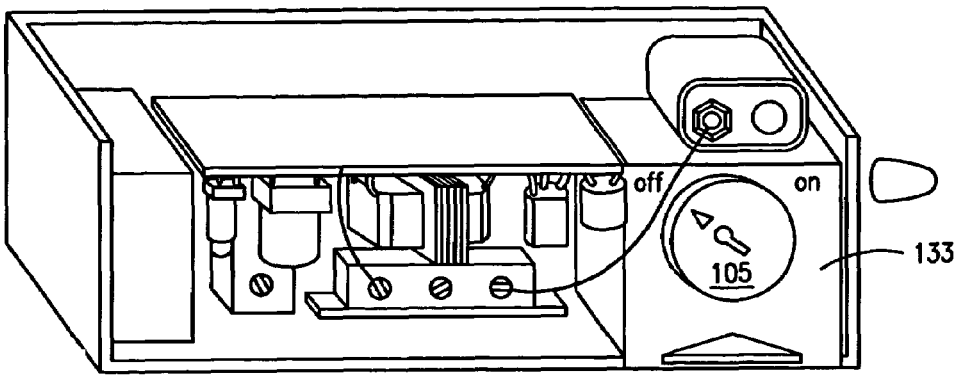
FIG. 10 is a partially cut away perspective view of a transmitter showing a key-actuated magnet.
Figure 11:
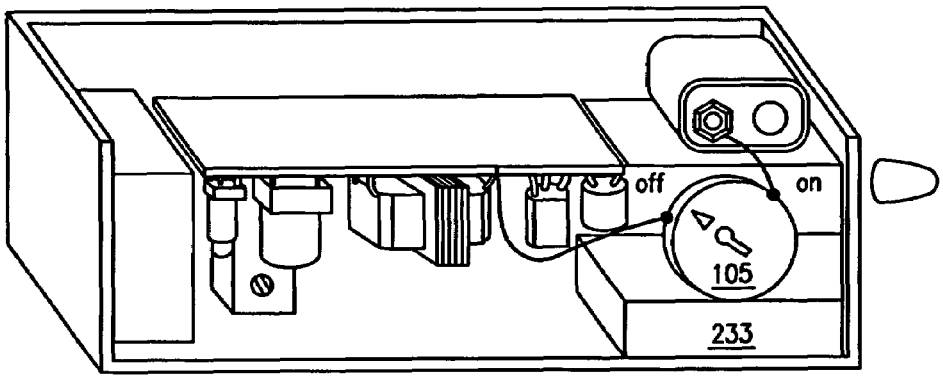
FIG. 11 is a partially cut away perspective view of a transmitter with a permanent magnet and an electrical key switch.
Figure 12:
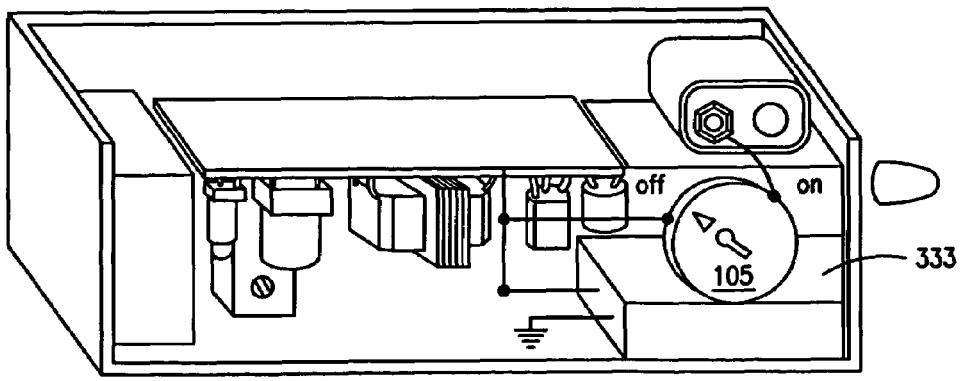
FIG. 12 is a partially cut away perspective view of a transmitter within an electromagnet.

According to an alternative embodiment of the present invention, as shown in FIG. 10, a switch-actuated, most preferably key-actuated, magnet 133 of the type commonly used in a magnetic base is employed to removably connect a transmitter to an electrical device. According to a still further embodiment shown in FIG. 11, if a permanent magnet 233 is utilized, it is within the scope of the present invention to add an electrical key switch 105 to arm the alarm. FIG. 12 illustrates an electromagnet 333 wired in parallel to the circuit. Preferably, actuation of magnet 133, and actuation of an electromagnet 333, will also arm the alarm.

I claim:

1. A system for signaling undesired activity at an electrical device, said system comprising:

a) a transmitter, a switch coupled to said transmitter and actuatable in response to movement of said switch relative to the electrical device and means for connecting the switch to the electrical device, wherein said connecting means comprises at least one magnet; and b) a portable receiver comprising a discernible signal generator, wherein a discernible signal is generated by said portable receiver when said switch is actuated.

2. A system according to claim 1 wherein said magnet is a switch-actuated magnet.

3. A system according to claim 1 wherein said magnet comprises an electromagnet.

4. A system according to claim 1 wherein said switch comprises a vibration sensor.

5. A system according to claim 1 wherein said switch comprises a spring-biased switch.

6. A system according to claim 1 wherein said transmitter comprises a key switch coupled to said switch.

7. A system according to claim 6 wherein after said transmitter is activated, it can only be deactivated by said key switch.

8. A system according to claim 1 wherein said transmitter comprises a discernible signal generator which generates a discernible signal when said switch is actuated.

9. A system according to claim 1 wherein said discernible signal comprises an audible signal.

10. A system according to claim 1 wherein said discernible signal comprises an visible signal.

11. A system according to claim 1, comprising tag-out indicia for indicating the location of affected equipment and/or personnel.

12. A system according to claim 1 wherein said transmitter comprising a folding flap for obstructing a portion of the electrical device.

13. A system according to claim 1 wherein said discernible signal comprises both an audible signal and a visible signal.

14. A transmitter for use with a portable receiver for creating a discernible signal in response to undesired activity at protected equipment, said transmitter comprising:

a) a transmitter for transmitting a signal to the portable receiver;

b) at least one switch coupled to said transmitter, said switch responsive to movement wherein movement of said switch will activate said transmitter causing the signal to be transmitted to the portable receiver; and c) means for connecting said switch to said protected equipment, wherein said connecting means comprises at least one magnet.

15. A transmitter according to claim 14 wherein said magnet is a switch-actuated magnet.

16. A transmitter according to claim 14 wherein at least one of said magnets comprises an electromagnet.

17. A transmitter according to claim 14 wherein said switch comprises a vibration sensor.

18. A transmitted according to claim 14 wherein said switch comprises a spring-biased switch.

19. A transmitter according to claim 14 comprising a key switch coupled to said switch.

20. A transmitter according to claim 19 wherein after said transmitter is activated, it can only be deactivated by said key switch.

* * * * *